US008695968B2

(12) United States Patent
Dopfer et al.

(10) Patent No.: US 8,695,968 B2
(45) Date of Patent: Apr. 15, 2014

(54) DEVICE FOR HANDLING SHEET MATERIAL

(75) Inventors: Peter Dopfer, Geltendorf (DE); Markus Sperl, Garching (DE)

(73) Assignee: Giesecke & Devrient GmbH, Munich (DE)

( * ) Notice: Subject to any disclaimer, the term of this patent is extended or adjusted under 35 U.S.C. 154(b) by 156 days.

(21) Appl. No.: 12/677,411

(22) PCT Filed: Sep. 9, 2008

(86) PCT No.: PCT/EP2008/007375

§ 371 (c)(1),
(2), (4) Date: Mar. 10, 2010

(87) PCT Pub. No.: WO2009/033636

PCT Pub. Date: Mar. 19, 2009

(65) Prior Publication Data

US 2010/0194029 A1 Aug. 5, 2010

(30) Foreign Application Priority Data

Sep. 11, 2007 (DE) ..... 10 2007 043 129

(51) Int. Cl.
*B65H 1/26* (2006.01)

(52) U.S. Cl.
USPC ..... 271/157; 271/158; 271/145

(58) Field of Classification Search
USPC ..... 271/157, 158, 159, 145
See application file for complete search history.

(56) References Cited

U.S. PATENT DOCUMENTS 4,796,879 A * 1/1989 Martini et al. ..... 271/218
5,713,713 A * 2/1998 Syde et al. ..... 414/403
5,803,446 A 9/1998 Leuthold
6,026,967 A * 2/2000 Isaacs et al. ..... 209/539
6,135,697 A 10/2000 Isaacs
6,398,000 B1 6/2002 Jenrick

FOREIGN PATENT DOCUMENTS

DE 4205553 A1 8/1993
DE 19512505 A1 10/1996
WO 02/060793 A1 8/2002
WO 2005003005 A1 1/2005

OTHER PUBLICATIONS

International Search Report in PCT/EP2008/007375, Jan. 14, 2009.

* cited by examiner

*Primary Examiner* — Michael McCullough
*Assistant Examiner* — Howard Sanders
(74) *Attorney, Agent, or Firm* — Workman Nydegger

(57) ABSTRACT

Apparatus for continuous singling of stacks of loose sheet material, in particular bank notes, vouchers, checks, separation cards, etc., includes a singling unit for singling stacks of loose sheet material and a feeding device which transports stacks of loose sheet material to be singled into a position where sheet material of the stack is grasped by the singling unit and transferred to a transport system. The feeding device has a first, substantially single-axis moved feeding element and a second, substantially multi-axis moved feeding element. A container is provided to receive the stack of loose sheet material, the container having a movable platform on which the stack of sheet material rests. The container is received by a container receiving device which has a transport device connected to the platform of the container located in the container receiving device, wherein the platform of the container together with the transport device forms the first feeding element.

7 Claims, 6 Drawing Sheets

DEVICE FOR HANDLING SHEET MATERIAL

BACKGROUND

1. Field

This invention relates to an apparatus for continuous singling of stacks of loose sheet material, in particular bank notes, vouchers, checks, separation cards, etc.

2. Related Art

In the processing of bank notes with bank-note processing machines, great importance is attached to the preparation of the bank notes to be processed. Often, bank notes are present in relatively disordered fashion, so that they cannot be readily inserted into the input pocket of a singler of the employed bank-note processing machine. Normally, disordered bank notes are formed by an operator into a stack which can be inserted into the input pocket of the singler in order for the bank notes to be grasped individually by the singler. The individual bank notes are subsequently processed in the bank-note processing machine. For this purpose, the properties of the bank notes are ascertained by sensors, for example their type, i.e. denomination and currency, their authenticity, their state, i.e. soiling, defects, etc., their suitability for further circulation, their position and orientation, etc. Further processing of the bank notes is effected in accordance with the ascertained properties, e.g. they are sorted into certain output pockets or destroyed by means of a shredder if the bank notes are too damaged or soiled so as to be no longer suitable for further circulation.

If it is necessary to separate different groups of bank notes from each other, e.g. bank notes coming from different depositors, there are inserted so-called separation cards between the bank notes of the different depositors. Said separation cards can be recognized by the sensors of the employed bank-note processing machine in order to separate the bank notes of the different deposits from each other. The separation cards can furthermore have information which can likewise be detected by the sensors and characterizes the different depositors, so that the different deposits can be associated with the particular depositor.

Preparation of the bank notes and optionally separation cards often requires considerable effort, however, so that preparation immediately before input to the input pocket of the singlet of the employed bank-note processing machine is always problematic when the employed bank-note processing machine processes bank notes at high speed. For in these cases there occur idle times of the bank-note processing machine, since the operator cannot insert a sufficient amount of bank notes into the input pocket of the singler because of the time required for preparation.

Therefore, the preparation of bank notes to be processed is often carried out in such a way that the bank notes, optionally together with separation cards, are inserted into boxes. Said boxes are brought to the bank-note processing machine. Then an operator must only remove the bank notes, optionally together with the separation cards, and insert the stack formed by the bank notes and optionally separation cards into the input pocket of the singler.

The described procedure is to be considered disadvantageous, because one or more operators must first insert the bank notes and optionally separation cards into the boxes for preparation. Subsequently, it is necessary that the bank notes and optionally separation cards deposited in stacks in the boxes must be grasped again by an operator in a further working step and inserted into the input pocket of the singler of the bank-note processing machine.

From DE 195 12 505 A1 there is known an apparatus for singling sheet material wherein sheet material to be singled is fed to an input pocket which consists of an upper portion and a lower portion. Through the use of two means of rakelike configuration moving vertically and horizontally within the input pocket it can be achieved that the singling of sheet material is effected without interruption, because further sheet material can already be inserted into the input pocket when previously inserted sheet material has not yet been completely singled. For this purpose, the described means alternatingly engage the input pocket and alternatingly transport sheet material into the singling position. Additionally it is proposed to realize the upper and lower portions of the input pocket as separate constructional elements, thereby making it possible to provide a multiplicity of lower portions into which sheet material to be singled can be inserted. For singling, sheet material is deposited on a platform of the particular lower portion and the lower portions can be transported to the singler by means of a transport system. At the singler the lower portions are conjoined with the upper portion and the singling of sheet material can be effected.

In the described procedure and apparatus it is to be considered disadvantageous, however, that the input pocket is divided into upper and lower portions. Consequently, an elaborate design of the lower portion with a stationary platform as well as the two described vertically and horizontally moving means associated with the upper portion is necessary in order to allow uninterrupted singling. Moreover, the lower portions must be designed as open carriers for sheet material to be singled. The latter do not have any great handling safety, because inserted sheet material can fall out of the open lower portions if they are not handled and transported very carefully.

From WO 2005/003005 A1 there is known a less elaborate apparatus for handling sheet material upon singling. There are likewise provided two means for feeding sheet material into the singling position. The feeding means are so used that the first feeding means receives a first stack of loose sheet material to be singled in the deposit position and guides it through a single-axis motion into a position where the uppermost sheet of the stack can be grasped by the singler. It thereby continuously feeds the stack decreasing in the course of sheet-by-sheet singling, so that the particular uppermost sheet of the stack can be grasped by the singler and singled. The second, only single-axis movable feeding means is meanwhile located in the deposit position and, during the singling of the first stack, receives a second stack likewise to be singled and to be fed and guides it out of the deposit position into a position where the uppermost sheet of the second stack comes to lie directly below the first feeding means. Thereupon the first stack to be singled and the fed second stack are conjoined by drawing the first feeding means now positioned between the two stacks out of the feeding path. Subsequently, the first feeding means is inserted into the feeding path at the position of the second feeding means on a loop path and thus takes over the conjoined stack from the second feeding means. The second feeding means can now return to the deposit position through another single-axis motion on the feeding path to receive the next stack to be singled.

This apparatus has the advantage that it is designed substantially more simply with regard to the means employed for feeding sheet material to the singler. Additionally, a stationary deposit area can be omitted. However, in this apparatus it is exclusively possible to place loose sheet material into the feeding mechanism in the form of stacks. Therefore, it is not possible to prepare sheet material for singling on a larger scale, without one or more operators having to handle the sheet material manually several times. Moreover, it is only possible to form stacks of small size to be able to place them into the feeding mechanism. Also, the use of boxes for preparing sheet material is not very helpful, since bank notes inserted into boxes must, for further processing, i.e. singling, be manually removed from the box by an operator again and inserted into the input pocket of the singler in order for the sheet material to be brought by the feeding mechanism into the singling position.

SUMMARY OF THE INVENTION

Starting out from this prior art, the invention is based on the object of specifying an apparatus for continuous singling of stacks of loose sheet material, in particular bank notes, vouchers, checks, separation cards, etc., which simplifies handling of the sheet material and makes it safer while reducing effort.

The invention is based on the finding that in an apparatus for continuous singling of loose sheet material, having a singling unit for singling stacks of loose sheet material and a feeding device which transports stacks of loose sheet material to be singled into a position where sheet material of the stack is grasped by the singling unit and transferred to a transport system, wherein the feeding device has a first, substantially single-axis moved feeding element and a second, substantially multi-axis moved feeding element, there is provided a container which receives the stack of loose sheet material, wherein the container has a movable platform on which the stack of sheet material rests, wherein the container is received by a container receiving means of the apparatus which has a transport device which is connected to the platform of the container located in the container receiving means, wherein the platform of the container together with the transport device forms the first feeding element.

The advantage of the inventive solution consists in the fact that the use of the containers permits continuous singling even of very large amounts of loose sheet material. Sheet material is divided up over a plurality of containers which are successively input to the container receiving means and whose content is singled. Through connection of the platform of the container located in the container receiving means to the transport device upon insertion of the container into the container receiving means there arises, without additional constructional effort, the first feeding element of the apparatus which allows uninterrupted singling of sheet material contained in a plurality of containers together with the second feeding element. In this manner it is possible to input large amounts of bank notes in relatively large stacks and single them without interruption. Moreover, loose bank notes must be handled by an operator only once upon insertion into one of the containers, which results in a substantial simplification of the processing operation.

In an advantageous embodiment of the invention, the apparatus has one or more processing stations for filling containers with loose sheet material which are connected via a container transport system, wherein the container transport system transports filled containers from the processing stations into at least one container receiving means of at least one apparatus, and emptied containers from the container receiving means back to the processing stations.

This embodiment of the invention has the advantage that a great number of containers can be prepared, so that a largely automatic processing of sheet material located in the containers can subsequently be effected.

BRIEF DESCRIPTION OF THE DRAWINGS

Further embodiments and advantages of the invention will be explained hereinafter with reference to the figures and the description thereof.

Therein are shown

DETAILED DESCRIPTION OF PREFERRED EMBODIMENTS OF THE INVENTION

Figure 1:
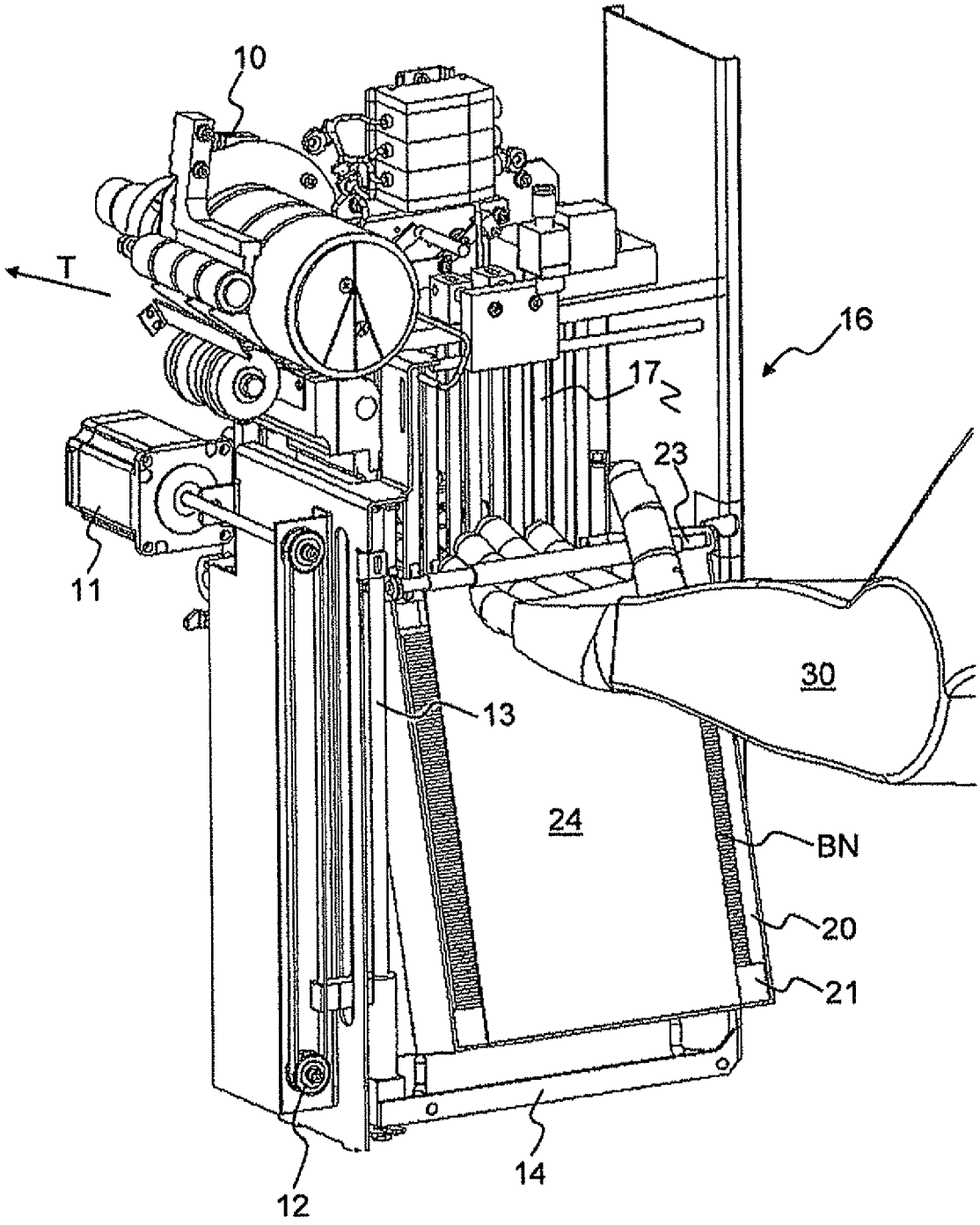
FIGS. 1 to 5 an embodiment of an inventive apparatus for continuous singling of sheet material at different processing times, and FIG. 6 an extension of the inventive apparatus for continuous singling of sheet material, for improved preparation of sheet material to be singled.

FIG. 1 shows an embodiment of an inventive apparatus for continuous singling of sheet material upon processing of the sheet material e.g. in a bank-note processing machine. Upon processing, loose sheet material BN present in a stack is grasped by a singling unit 10 and transferred to a transport system (not shown in detail) which transports the individual sheet material in the direction of the arrow T for further processing. Sheet material BN in the stack can be formed by documents such as bank notes, vouchers, checks, separation cards, etc.

At the time shown in FIG. 1, a container 20, in particular a cassette for bank notes, is inserted into a container receiving means 16. This can be performed by an operator 30, as shown, but also by a mechanism, e.g. a robot. The operator 30 for this purpose grasps the cassette 20 on a handle 23. After insertion of the cassette 20 into the container receiving means 16, a cover (not shown) closing the top of the cassette 20 can, by shifting the handle 23, be removed, e.g. by swiveling the cover in a direction toward the operator. The cassette 20 has a housing 24 enclosing the bank notes, which is shown only partly in the subsequent figures to permit the functioning of the apparatus to be made clearer. For the same reason there is an incomplete representation of guiding elements 17 which serve to guide the bank notes BN forming the stack after they have been moved out of the cassette 20 and are located above the upper edge of the housing 24 of the cassette 20.

Upon insertion of the cassette 20 into the container receiving means 16, a platform 21 located in the cassette 20 is coupled to a transport device 11 to 14 to form a first feeding element. By means of a motor 11, a drive 12 and a guiding means 13, a coupled connection element 14 moves the platform 21 such that the stack of bank notes BN located in the cassette 20 is transported in the direction of the singling unit 10 until the first bank note of the stack of bank notes BN can be grasped by the singling unit 10 and transferred to the transport system T. Subsequently the platform 21, or the first feeding element, is continuously moved further by the transport device 11 to 14 in order for the bank notes BN of the stack to be grasped successively by the singling unit 10 and singled.

After the platform 21 has reached its upper end point, i.e. the upper edge of the cassette 20, or of the housing 24 of the cassette 20, a second feeding element 15 grasps the stack of bank notes BN and continues transport of the stack of bank notes BN in the direction of the singling unit 10.

Figure 2:
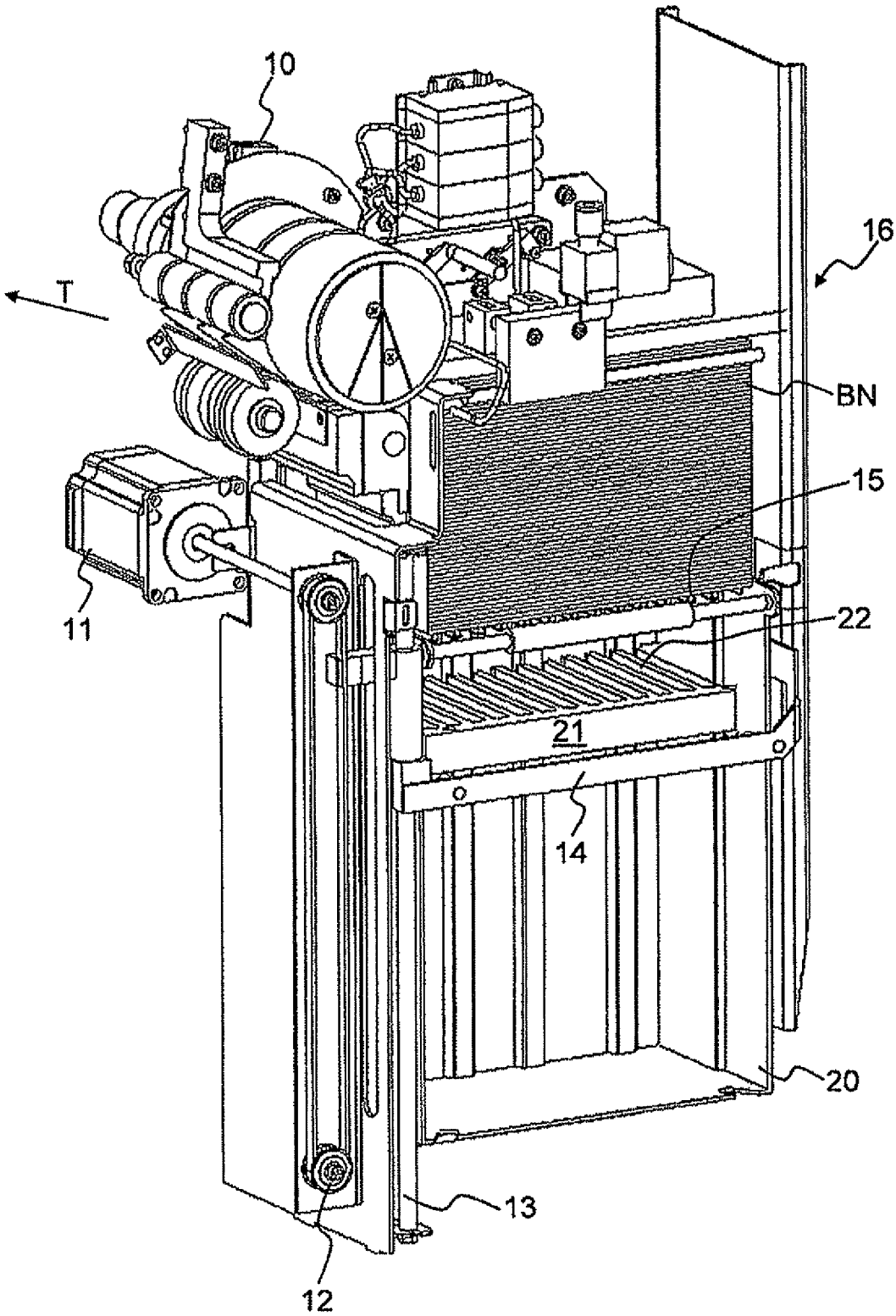

As shown in FIG. 2, after the stack of bank notes BN has been taken over by the second feeding element 15, the platform 21 of the cassette 20 is lowered by the transport device 11 to 14 and the cassette 20 can be removed from the container receiving means 16. The cassette 20 can also be removed without the platform 21 being lowered, in which case the connection element 14 of the transport device 11 to 14 is subsequently lowered alone in order for a further cassette to be inserted into the container receiving means 16.

As also to be recognized in FIG. 2, the platform 21 of the cassette has gaps 22 which can be engaged by the second feeding unit 15 of rake-shaped design, in order for the latter to take over the stack of bank notes BN from the platform 21 forming the first feeding unit.

Figure 3:
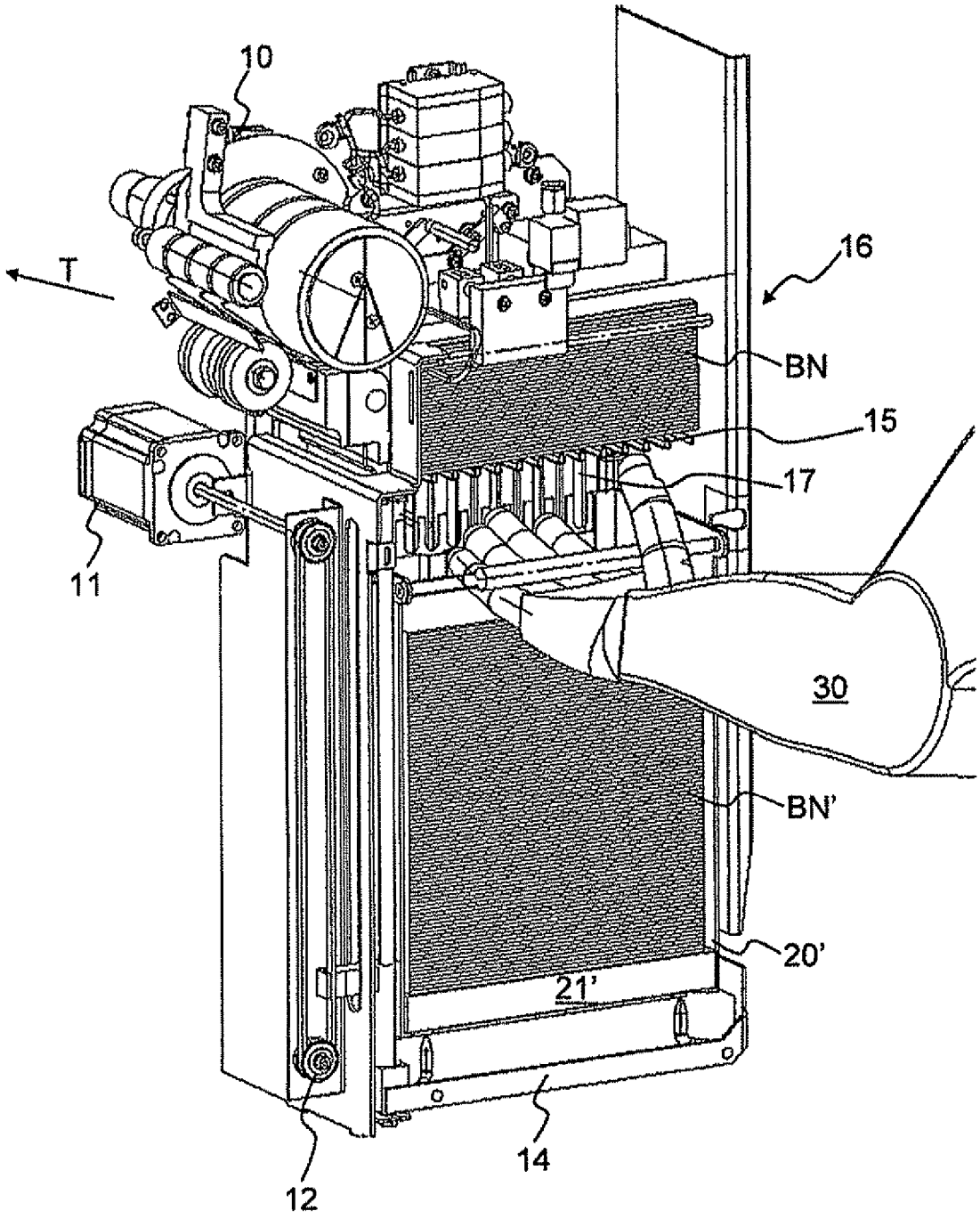

During removal of the cassette 20, the stack of bank notes BN is moved by the second feeding element 15 further in the direction of the singling unit, in order for the latter to keep up the continuous singling of bank notes BN. The continued singling can be recognized in FIG. 3 by the reduced stack of bank notes BN at the time when a further cassette 20' is input to the container receiving means 16. Further, it can be recognized that the guiding elements 17 also have interruptions which allow the second feeding element 15 to transport the bank notes BN.

Figure 4:
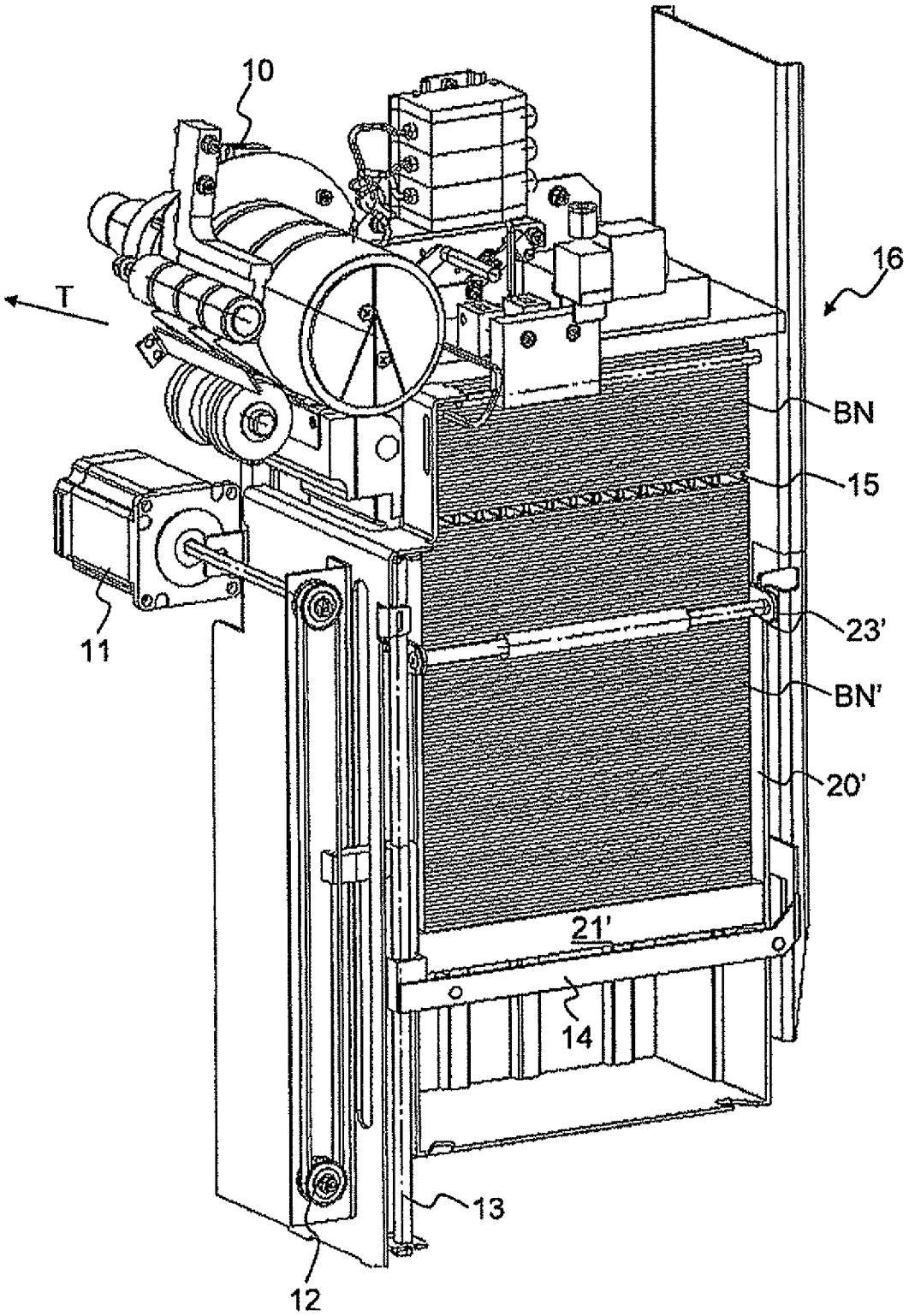

As to be recognized in FIG. 4, the platform 21' of the further cassette 20' is transported by the transport device 11 to 14 in the direction of the singling unit 10 until the uppermost bank note of the stack of bank notes BN' touches the second feeding element 15.

Figure 5:
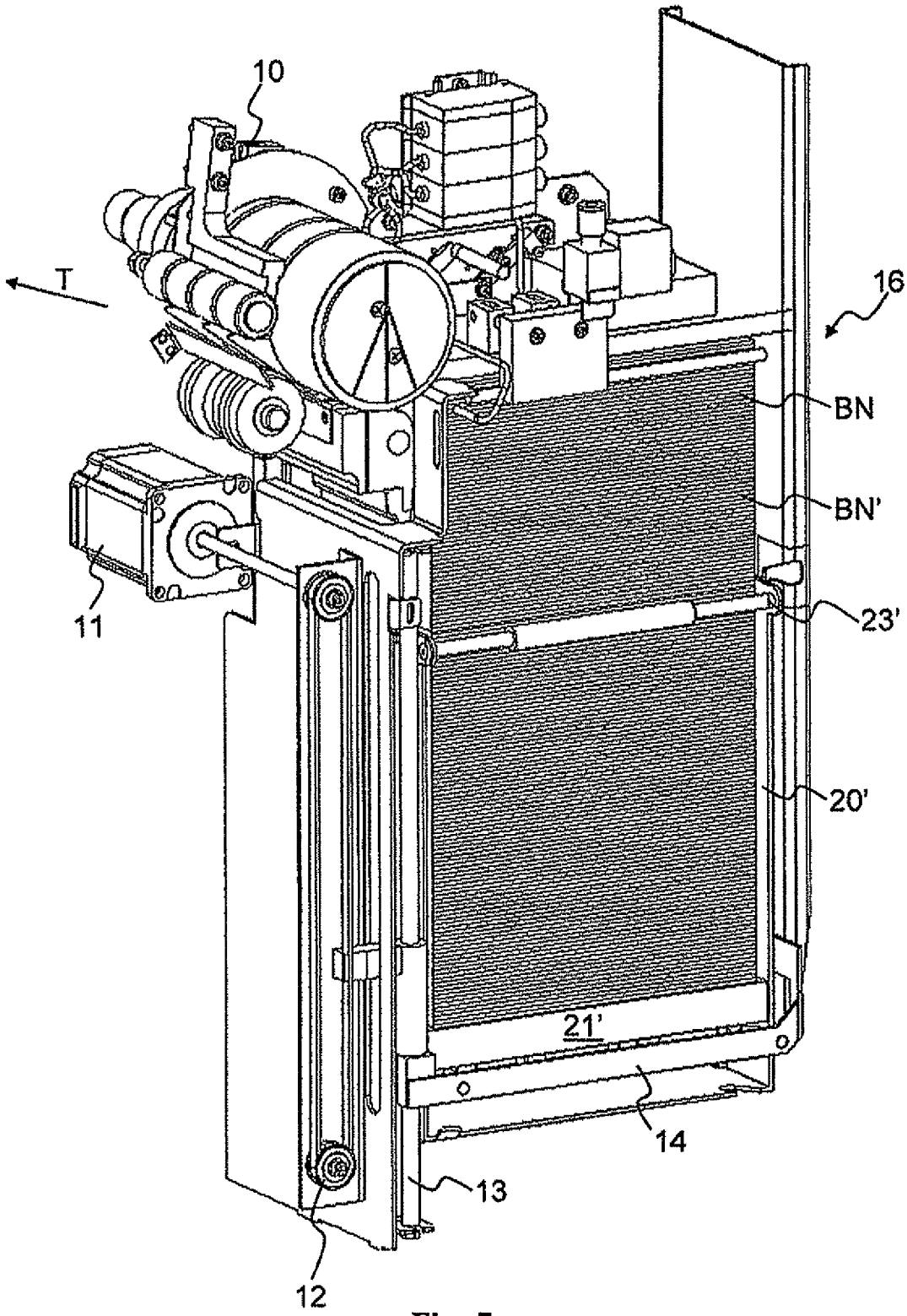

As to be recognized from FIG. 5, the second feeding element 15 is subsequently removed and the first stack of bank notes BN and the further stack of bank notes BN' are conjoined into a stack. The total stack comprising the bank notes BN and BN' is transported by the first feeding element, which is formed by the transport device 11 to 14 and the platform 21' of the further container 20', further in the direction of the singling unit 10 which can keep up the continuous singling. This process is continued until the platform 21' has reached the upper edge of the further cassette 20', whereupon the second feeding element 15 takes over the transport of the bank notes again. All in all, the process described above from FIG. 2 on is thus repeated as long as further cassettes 20' are inserted. When no further cassette 20' is inserted, all bank notes BN' present from the last inserted cassette 20' are singled, for which purpose they are transported by means of the second feeding element 15 in the direction of the singling unit 10. After singling of the last bank note, the second feeding element 15 is removed.

During the above-described singling process and the transport of the bank notes BN or BN' by means of a feeding device consisting of the feeding elements 15, 21 or 21', the first feeding element formed by the platform 21 or 21' of the cassette 20 or 20' is moved substantially only in single-axis fashion, in particular vertically in the direction toward the singling unit 10 and away therefrom. The second feeding element 15 is moved in the form of a loop, whereby it protrudes into the area formed by the guiding elements 17 above the cassette 20 or 20' and below the singling unit 10 during the motion toward the singling unit 10, while it is removed from said area upon the motion away from the singling unit 10. In so doing, the second feeding element 15 performs a multi-axis motion, in particular a dual-axis motion, in particular vertically in the direction toward the singling unit 10 and away therefrom, and horizontally into the area formed by the guiding elements 17 above the cassette 20 or 20' and below the singling unit 10 and out thereof.

Besides the described embodiment of the apparatus for continuous singling of loose sheet material, other embodiments are possible.

In particular, a different arrangement of the second feeding element 15 is possible, which accesses the bank notes e.g. not along the long side of the cassette 20 but along the short side of the cassette 20.

Likewise, it is possible that it is not the upper edge of the cassette 20 that forms the limitation of the motion of the platform 21 of the cassette 20. Upper edge should be understood here to mean that the platform 21 of the cassette 20 is moved so far as to permit the engagement of the second feeding element 15 in order to take over the stack of bank notes BN for further transport to the singling unit 10. In particular, there can be provided for this purpose gaps in the housing 24 which allow engagement of the second feeding element 15.

Figure 6:
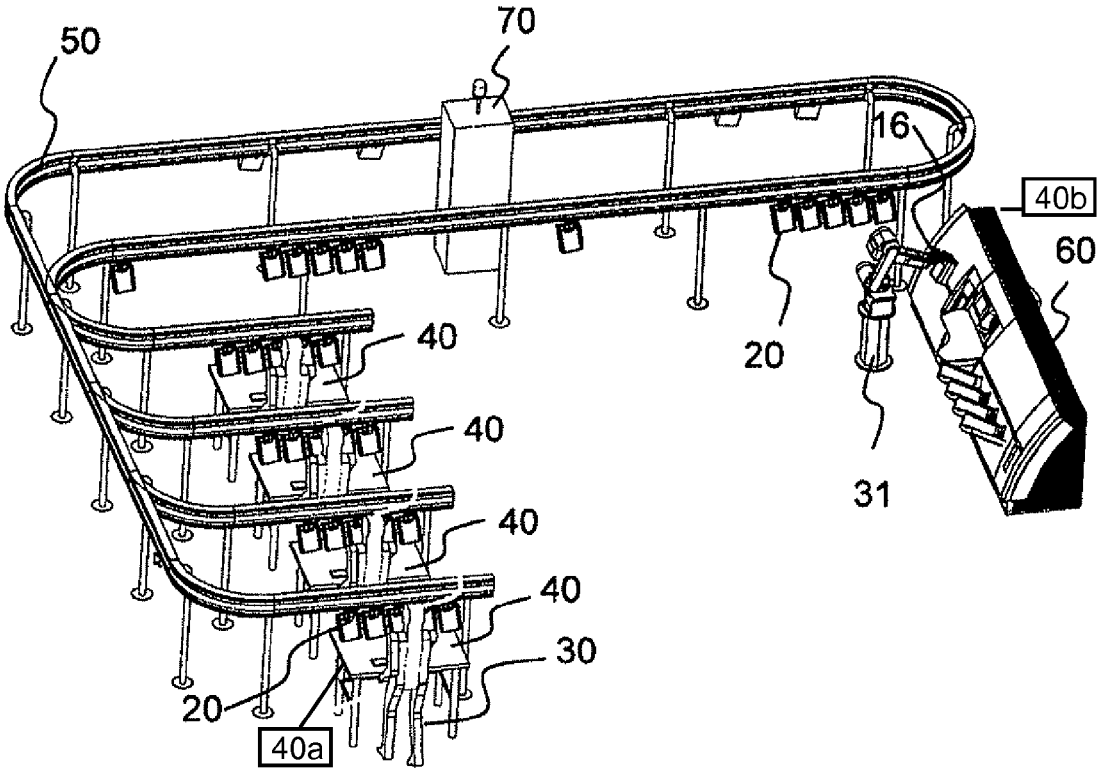

An extension of the inventive apparatus for continuous singling of loose sheet material, for the purpose of improved preparation of sheet material to be singled, is shown in FIG. 6.

At one or more processing stations 40 for preparation of loose sheet material to be singled, operators 30 can input sheet material to be singled, in particular bank notes, vouchers, checks, separation cards, etc., to containers 20. The containers 20 are fed to a container transport system 50 which transports the containers 20 filled with bank notes to one or more bank-note processing machines 60. A robot 31 which is part of the container transport system 50, or alternatively an operator, inserts a container 20 into the container receiving means 16 of the bank-note processing machine 60. After the second feeding element 15 has taken over the bank notes to be singled—as described above in connection with FIGS. 1 to 5—the emptied container 20 is removed from the container receiving means 16. The emptied container 20 is fed to the container transport system 50 again, whereupon the robot 31 inserts a further container 20 into the container receiving means 16. The emptied containers 20 are transported by the container transport system 50 back to the processing station or stations 40 to be able to be filled with bank notes again. Should disturbances occur in the operation of the container transport system 50 or the bank-note processing machine 60, they can be indicated by means of a signal device 70 in order for an operator to intervene for trouble-shooting.

For further automation, the containers 20 can have codings, e.g. in the form of machine-readable characters, e.g. bar codes, electronic memories, e.g. RFIDs, etc. Upon preparation at the processing stations 40, the codings of the containers 20 can be linked with the bank notes filled in the containers and forming e.g. deposits of certain persons, etc. For this purpose, corresponding reading and/or writing devices **40*a* are present for the codings at the processing stations 40. The same kind of reading and/or writing devices 40*b* are present at the container receiving means 16 of the bank-note processing machine 60** to permit the information contained in the codings of the containers to be taken into account upon processing of the bank notes.

The invention claimed is:

1. An apparatus to continuously single loose sheet material comprising:

a singling unit arranged to single stacks of loose sheet material;

at least one first container arranged to receive a first stack of loose sheet material, wherein the first container has a movable platform on which the stack of sheet material rests when received, said first container having the movable platform configured in a way such that the movable platform moves linearly within the at least one first container;

a container receiving device arranged to receive the at least one first container, the container receiving device including a transport device, wherein the transport device is arranged to be connected to the movable platform of the at least one first container located in the container receiving device to form a first single-axis moved feeding element; and a second multi-axis moved feeding element connected to the apparatus, said second feeding element being configured to grasp the stack of loose sheet material from the first feeding element;

wherein the first feeding element and the second feeding element form a feeding device arranged to transport the first stack of loose sheet material from the first container to be singled into a position where sheet material of the first stack is grasped by the singling unit and transferred away from the singler, wherein the first feeding element comprises gaps arranged to be engageable with portions of the second feeding element so that the first and second feeding elements are complementary joined so that the second feeding element is enabled to grasp the first stack of loose sheet material from the first feeding element to transport the stack of loose sheet material to the singler, wherein the container receiving device is arranged to receive at least one second container having a second stack of loose sheet material, wherein the first and second feeding devices are configured to join the second stack of loose sheet material from the second container with the first stack of loose sheet material from the first container, and wherein the apparatus further comprises a motor, a drive, a guiding device, and a coupled connection element configured to move the movable platform linearly within the at least one first container.

2. The apparatus according to claim 1, wherein the movable platform is movable by the transport device up to an upper edge of the container where the second feeding element is arranged to take over the stack of loose sheet material from the first feeding element in the area of the upper edge of the container.

3. The apparatus according to claim 2, wherein the transport device is arranged to lower the platform comprising the first feeding element after the stack of loose sheet material has been taken over by the second feeding unit.

4. The apparatus according to claim 2, wherein, upon removal of the at least one first container from the container receiving device, the at least one second container is receivable by the container receiving device, and the transport device is arranged to transport the platform of the first feeding element in the at least one second container located in the container receiving device until the sheet material contained in the second container touches the second feeding unit; the second feeding unit being arranged to be removable from the area of the sheet material.

5. The apparatus according to claim 1, wherein one or more processing stations arranged to fill containers with loose sheet material are connected to a container transport system, wherein the container transport system is arranged to transport filled containers from the processing stations to at least one container receiving device, and to transport emptied containers from the container receiving devices back to the processing stations.

6. The apparatus according to claim 5, wherein the processing stations and the container receiving device have reading and/or writing devices arranged to read and/or write information from codings associated with the containers.

7. The apparatus according to claim 1, wherein the apparatus is part of a bank-note processing machine.

* * * * *